US007793757B2

(12) United States Patent
Letourneau et al.

(10) Patent No.: US 7,793,757 B2
(45) Date of Patent: Sep. 14, 2010

(54) RESONATOR WITH INTERNAL SUPPLEMENTAL NOISE ATTENUATION DEVICE

(75) Inventors: Mark Letourneau, Dover Center (CA); Jason Lorne Pettipiece, Chatham (CA)

(73) Assignee: Mahle International GmbH, Stuttgart (DE)

( * ) Notice: Subject to any disclaimer, the term of this patent is extended or adjusted under 35 U.S.C. 154(b) by 500 days.

(21) Appl. No.: 11/692,491

(22) Filed: Mar. 28, 2007

(65) Prior Publication Data

US 2008/0236937 A1 Oct. 2, 2008

Related U.S. Application Data

(60) Provisional application No. 60/743,985, filed on Mar. 30, 2006.

(51) Int. Cl.
*F02M 35/12* (2006.01)

(52) U.S. Cl. ..... 181/229; 181/249

(58) Field of Classification Search ..... 181/229, 181/249, 255, 269; 123/184.57
See application file for complete search history.

(56) References Cited

U.S. PATENT DOCUMENTS 3,966,014 A * 6/1976 Gowing ..... 181/229
4,065,276 A * 12/1977 Nakaya et al. ..... 96/380
4,420,063 A * 12/1983 Bohlmann et al. ..... 181/229
5,163,387 A * 11/1992 Lee ..... 123/184.38
5,333,576 A * 8/1994 Verkleeren ..... 123/184.53
5,647,314 A * 7/1997 Matsumura et al. .... 123/184.57
5,723,828 A * 3/1998 Nakagawa ..... 181/250
5,756,945 A * 5/1998 Maeda et al. ..... 181/272
5,929,397 A * 7/1999 Satoh et al. ..... 181/229
5,979,598 A * 11/1999 Wolf et al. ..... 181/272
6,006,712 A * 12/1999 Suzuki ..... 123/184.57
6,026,775 A * 2/2000 Yamane ..... 123/184.53
6,135,079 A * 10/2000 Fuesser ..... 123/184.57
6,155,225 A * 12/2000 Suzuki ..... 123/184.57
6,178,940 B1 * 1/2001 Gossling et al. ..... 123/184.57
6,508,331 B1 * 1/2003 Stuart ..... 181/250
6,715,580 B1 * 4/2004 Gerstner et al. ..... 181/224
6,938,601 B2 * 9/2005 Fukumoto ..... 123/184.57
7,111,601 B2 * 9/2006 Moenssen et al. ..... 123/184.53
2003/0085071 A1 * 5/2003 Boast et al. ..... 181/249
2003/0131897 A1 * 7/2003 Letourneau ..... 138/39

OTHER PUBLICATIONS

Prior Art Resonator, six (6) pages.

* cited by examiner

*Primary Examiner*—Jeffrey Donels
*Assistant Examiner*—Jeremy Luks
(74) *Attorney, Agent, or Firm*—Carlson, Gaskey & Olds, P.C.

(57) ABSTRACT

A resonator for an induction system includes an inlet and outlet with a resonator cavity arranged therebetween. A tube is arranged within the resonator cavity and at least partially extends between the inlet and outlet. In one example, at least one supplemental noise attenuation device is in communication with the arcuate tube, such as a quarter wave tube and/or Helmholtz resonator. A large opening is provided in the tube that opens into the resonator cavity. In one example, the large opening is arranged on an outer radius side and faces a large cavity portion of the resonator cavity. Additional supplemental noise attenuation is provided by a collar arranged concentrically relative to the tube providing an annular quarter wave tube that is coaxial with the direction of flow from the outlet.

7 Claims, 3 Drawing Sheets

RESONATOR WITH INTERNAL SUPPLEMENTAL NOISE ATTENUATION DEVICE

This application claims benefits to U.S. Provisional Patent Application No. 60/743,985, filed on Mar. 30, 2006.

BACKGROUND

This application relates to noise attenuation devices for use in induction systems, for example.

Resonators are used in induction systems for vehicle engines to provide broad noise attenuation. While resonators provide very good attenuation, it is typically desirable to supplement the noise attenuation provided by a resonator with additional noise attenuation devices, such as quarter wave tubes and/or Helmholtz resonators. Space in the engine compartment, where the resonator typically is located, is usually quite limited. As a result, it is difficult to package additional noise attenuation devices.

Resonators are typically large box-like structures providing an expansion chamber between an inlet and outlet. Due to packaging constraints, the inlet and outlet may not be in line with one another such that there is not a direct flow path through the resonator. As a result, pressure losses can occur as the air flows from the inlet to the outlet. One approach to minimizing pressure losses has been to provide an arcuate tube within the resonator and extending between the inlet and outlet, which are arranged at an angle relative to one another. The two-piece resonator includes one portion that provides one half of the arcuate tube. Another arcuate portion is secured over the half of the arcuate tube to connect the inlet and outlet. A series of elongated slots are provided near where the tube halves meet at both the inner and outer radius of the arcuate tube. A cover of the resonator is secured over the first portion to enclose the arcuate tube and provide the enclosed resonator cavity. The arcuate tube is intended to minimize pressure losses as the air flows between the inlet and outlet. The elongated slots are intended to take advantage of the resonator by providing fluid communication between the air within the arcuate tube and the resonator cavity. However, desired noise attenuation has not been achieved with this arrangement.

What is needed is an improved resonator with desired flow characteristics. What is also needed is supplemental noise attenuation requiring minimal space.

SUMMARY

A resonator for an induction system includes an inlet and outlet with a resonator cavity arranged therebetween. A tube is arranged within the resonator cavity and at least partially extends between the inlet and outlet. In one example, at least one supplemental noise attenuation device is in communication with the arcuate tube, such as a quarter wave tube and/or a Helmholtz resonator. A large opening is provided in the tube that opens into the resonator cavity. In one example, the large opening is arranged on an outer radius side and faces a large cavity portion of the resonator cavity. Additional supplemental noise attenuation is provided by a collar arranged concentrically relative to the tube providing an annular quarter wave tube that is coaxial with the direction of flow from the outlet.

Accordingly, an improved resonator is provided having improved flow characteristics and a supplemental noise attenuation device.

These and other features of the application can be best understood from the following specification and drawings, the following of which is a brief description.

DETAILED DESCRIPTION OF THE PREFERRED EMBODIMENT

Figure 1:
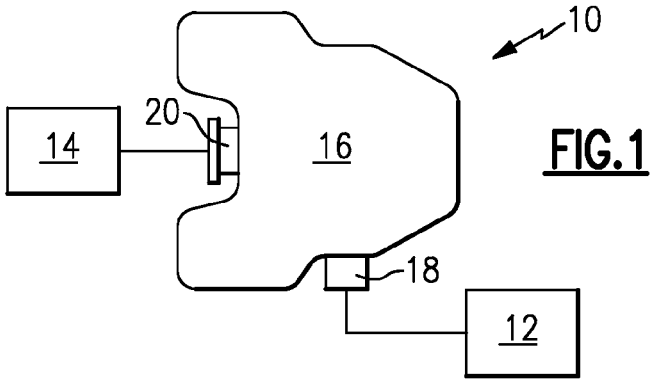
FIG. 1 is a schematic view of an example induction system.

An induction system 10 is schematically shown in FIG. 1. The induction system 10 includes an air source 12 or scoop that provides ambient air to a resonator 16 through an inlet 18. The ambient air flows through the resonator 16 from the inlet 18 to an outlet 20, which is in communication with an intake manifold of an engine 14. The resonator 16 provides broad noise attenuation to reduce undesired noise attributable to the induction system 10. The example resonator can also be used in exhaust systems, for example, to attenuate noise.

Figure 2:
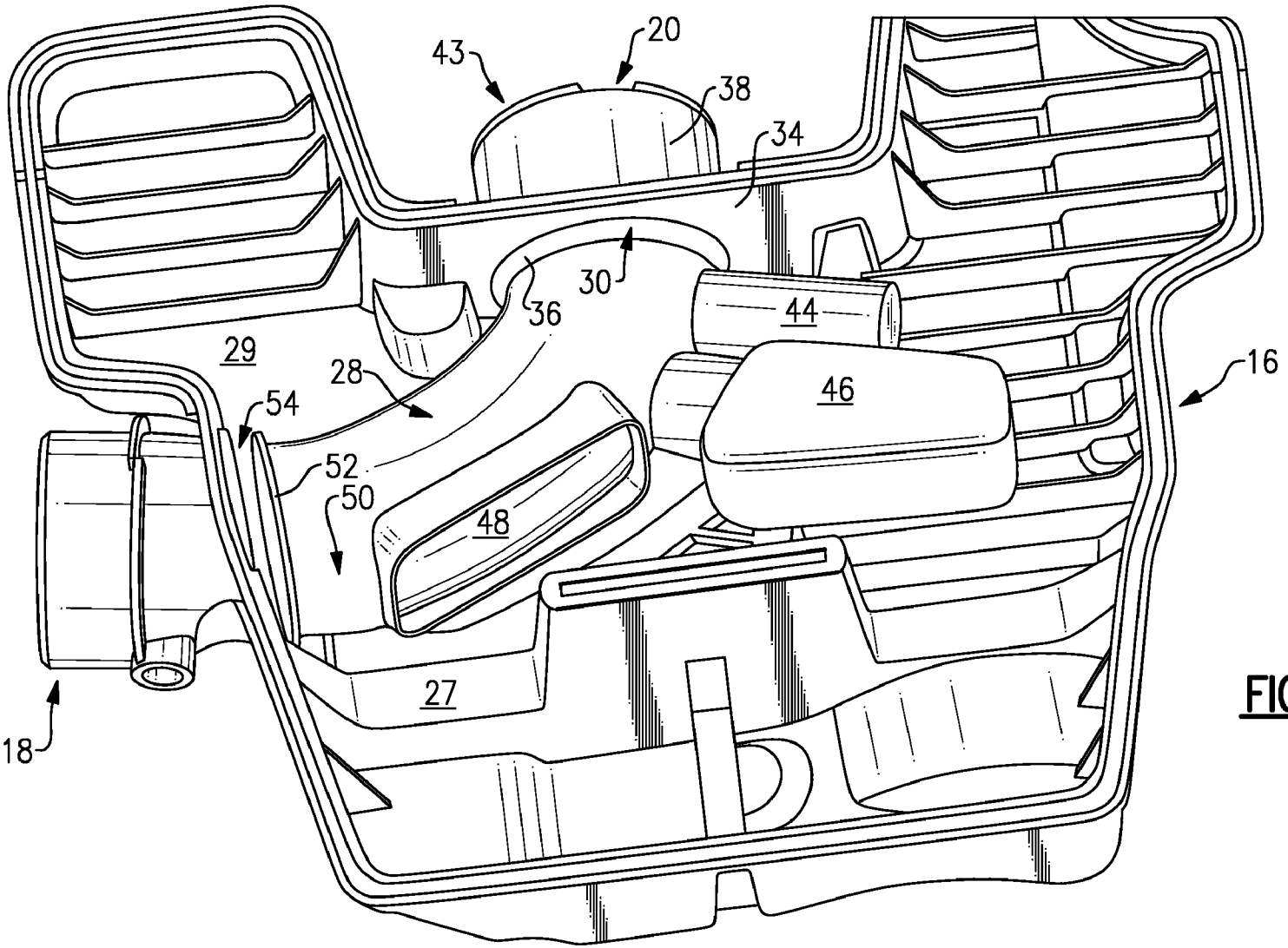
FIG. 2 is a cross-sectional view of an example resonator.

The resonator 16 is shown in FIG. 2 with its second portion 24 or cover (FIG. 4) removed from its first portion 22. The first and second portions 22, 24 provide a resonator cavity 26 arranged between the inlet 18 and outlet 20. A tube 28 is at least partially arranged between the inlet 18 and outlet 20 to improve the flow characteristics through the resonator 16 by minimizing pressure losses. In the example, the inlet 18 and outlet 20 are not coaxial with one another and are, for example, 90° relative to one another. The example tube 28 is annular in shape and generally separates the resonator cavity 26 into large and small cavity portions 27, 29.

Figure 3:
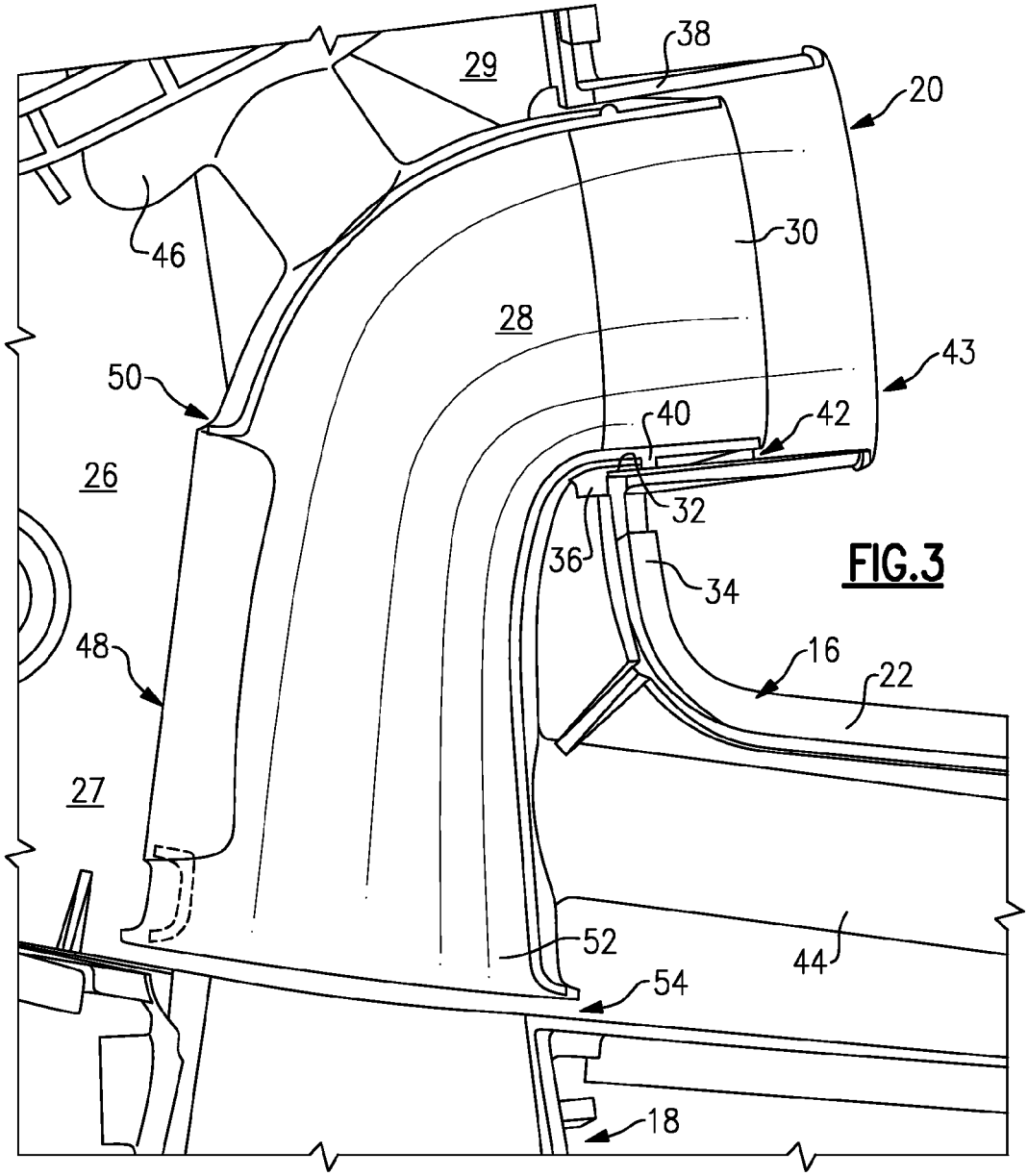
FIG. 3 is an enlarged cross-sectional view of a tube for use with the example resonator.
Figure 4:
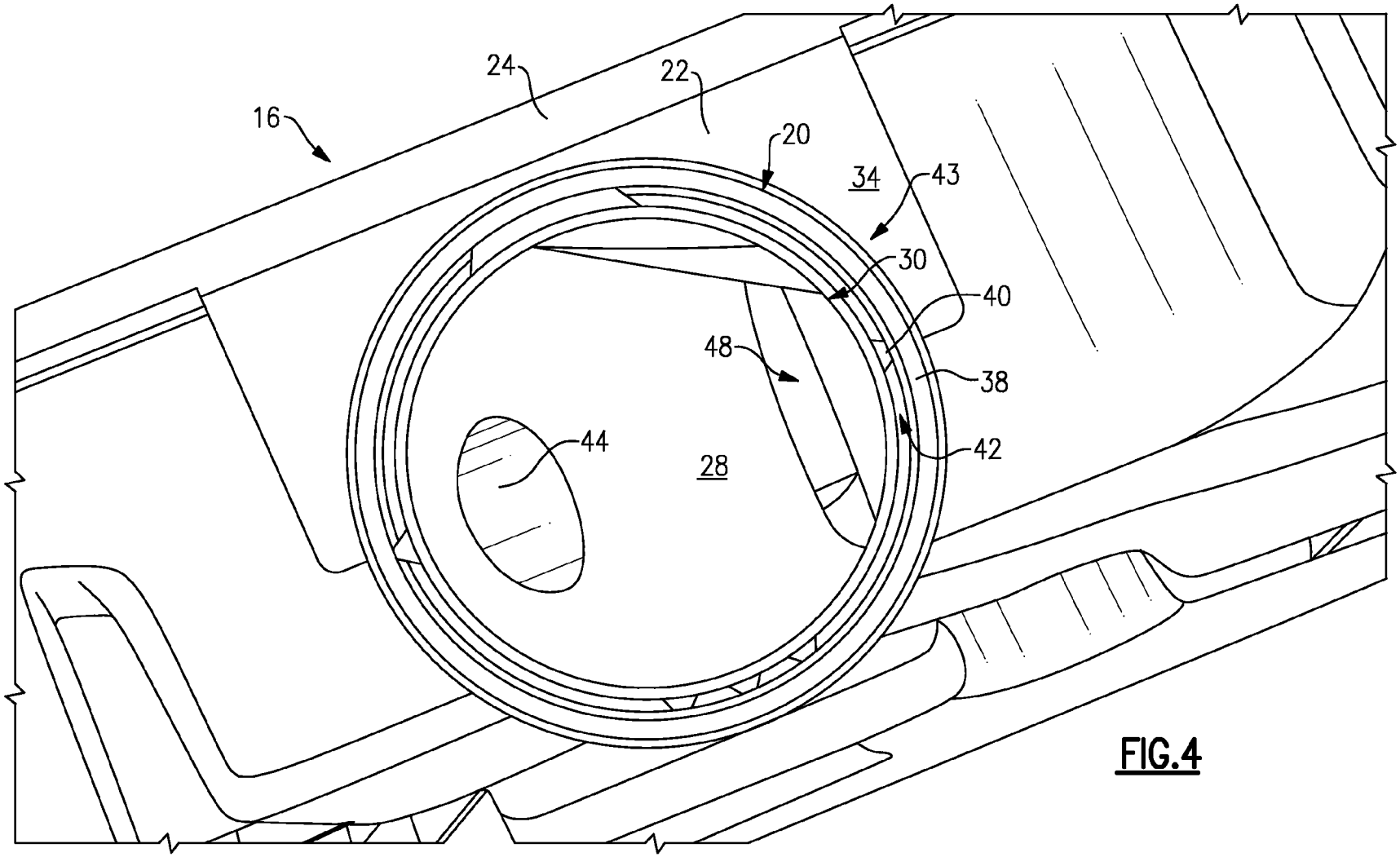
FIG. 4 is an end view of an outlet of the example resonator shown in FIG. 3.

The first portion 22 includes a sidewall 34 having a hole 32 that receives an end 30 of the tube 28. The tube 28 includes a flange 36 that seats against the sidewall 34 and locates the end 30 relative to the hole 32. Referring to FIGS. 3 and 4, a collar 38 is arranged concentrically about a portion of the end 30 that extends through the hole 32 and the sidewall 34, in the example shown. A duct (not shown) attached to the outside of the collar 38 connects the outlet 20 to the intake manifold, for example. A protrusion 40 extends radially outwardly from the end 30 to radially locate the collar 38 and tube 28 relative to one another. The concentric collar 38 and tube 28 provide an annular cavity 42, which provides supplemental noise attenuation by acting as an in-line quarter wave tube 43. The protrusion 40, sidewall 34 and/or flange 36 act as the bottom of the quarter wave tube 43.

Returning to FIG. 2, supplemental noise attenuation devices, such as quarter wave tube 44 and Helmholtz resonator 46, are in communication with the tube 28. In the example, the quarter wave tube 44 and Helmholtz resonator 46 are interconnected to the tube 28 near the outlet 20. It should be understood that, any number of quarter wave tubes and/or Helmholtz resonators may be used. The supplemental noise attenuation devices 44, 46 are arranged within the resonator cavity 26 thereby avoiding a need to find space for the noise attenuation devices outside of the resonator 16. In the example shown in FIG. 3, the Helmholtz resonator 46 is positioned in the small cavity portion 29 so as to avoid impacting the noise attenuation provided by the large cavity portion 27.

A large opening 48 is provided by the tube 28. The large opening 48 is arranged at the outer radius of the tube 28 opposite the inner radius and facing the large cavity portion 27, in the example shown. The large opening 48 is sized to provide sufficient airflow between the tube 28 and the resonator cavity 26 to obtain desired use of the resonator cavity 26.

The tube 28 includes a second end 52 that is spaced from the inlet 18, in the example shown, to provide a gap 54. The gap 54 facilitates insertion of the tube 28 into the resonator 16 during assembly. The components of the resonator 16 are plastic, for example, and may be glued, welded or otherwise secured to one another as desired. The gap 54 is also sized so as to minimize the pressure loss as the air flows from the inlet 18 to the outlet 20.

Although an example embodiment has been disclosed, a worker of ordinary skill in this art would recognize that certain modifications would come within the scope of the claims. For that reason, the following claims should be studied to determine their true scope and content.

What is claimed is:

1. A resonator for an induction system comprising:

a resonator body including a resonator cavity and an inlet and an outlet;

a tube extending at least partially between the inlet and the outlet, the tube generally separating the resonator cavity into large and small cavity portions, the tube including an opening facing the large cavity portion in communication with the resonator cavity, wherein the tube includes an open end supported by one of the inlet and the outlet, and an opposing open end opposite the end, the opposing open end spaced from and aligned with the other of the inlet and the outlet to provide a gap, the inlet and outlet in fluid communication with one another through the open ends of the tube, wherein the gap fluidly connects the large and small cavity portions; and a collar supported by the resonator body and supported concentrically relative to at least one of the inlet and the outlet, the collar and the at least one inlet and outlet providing an annular cavity configured to provide noise attenuation.

2. The resonator according to claim 1, wherein the tube is arranged within the resonator cavity the collar coaxial with the open end at the outlet to provide the annular cavity.

3. The resonator according to claim 2, wherein the tube includes a protrusion extending radially outwardly therefrom toward the collar radially locating the collar relative to the tube, the protrusion exposed to the annular cavity.

4. A resonator for an induction system comprising:

a resonator body including a resonator cavity and an inlet and an outlet;

a tube extending at least partially between the inlet and the outlet, the tube generally separating the resonator cavity into large and small cavity portions, the tube including an opening facing the large cavity portion in communication with the resonator cavity, wherein the tube includes an open end supported by one of the inlet and the outlet, and an opposing open end opposite the end, the opposing open end spaced from and, aligned with the other of the inlet and the outlet to provide a gap, the inlet and outlet in fluid communication with one another through the open ends of the tube, wherein the gap fluidly connects the large and small cavity portions;

a supplemental noise attenuation device including at least one of a Helmholtz resonator and a quarter wave tube is arranged within the resonator cavity and interconnected to the tube and extending therefrom into the large cavity portion; and a collar supported by the resonator body and supported concentrically relative to at least one of the inlet and the outlet, the collar and the at least one inlet and outlet providing an annular cavity configured to provide noise attenuation.

5. The resonator according to claim 4, wherein the gap is arranged at the inlet.

6. The resonator according to claim 5, wherein the inlet and outlet are at approximately 90° relative to one another.

7. The resonator according to claim 5, wherein the tube includes an inner and outer radius, and the opening is arranged on the outer radius.

* * * * *